US005593344A

United States Patent [19]

Weldon et al.

[11] Patent Number: 5,593,344

[45] Date of Patent: Jan. 14, 1997

[54] WAFER POLISHING MACHINE WITH FLUID BEARINGS AND DRIVE SYSTEMS

[75] Inventors: David E. Weldon, Los Gatos; Boguslaw A. Nagorski; Homayoun Talieh, both of San Jose, all of Calif.

[73] Assignee: Ontrak Systems, Inc., Milpitas, Calif.

[21] Appl. No.: 321,085

[22] Filed: Oct. 11, 1994

[51] Int. Cl.[6] ..... B24B 21/00

[52] U.S. Cl. ..... 451/296; 451/303; 451/307

[58] Field of Search ..... 451/296, 297, 451/398, 495, 505, 303, 490, 491, 516, 307

[56] References Cited

U.S. PATENT DOCUMENTS

| | | | |
|---|---|---|---|
| 619,399 | 2/1899 | Fischer . | |
| 3,447,306 | 6/1969 | Jakimcius | 451/297 |
| 3,654,739 | 4/1972 | Stoy et al. | 51/141 |
| 3,753,269 | 8/1973 | Budman . | |
| 3,906,678 | 9/1975 | Roth . | |
| 4,347,689 | 9/1982 | Hammond . | |
| 4,416,090 | 11/1983 | Jonasson . | |
| 4,593,495 | 6/1986 | Kawakami et al. . | |
| 4,628,640 | 12/1986 | Johannsen . | |
| 4,642,943 | 2/1987 | Taylor, Jr. | 451/296 |
| 4,704,823 | 11/1987 | Steinback . | |
| 4,811,522 | 3/1989 | Gill, Jr. | 51/131.1 |
| 4,934,102 | 6/1990 | Leach et al. . | |
| 4,941,293 | 7/1990 | Ekhoff . | |
| 5,081,795 | 1/1992 | Tanaka et al. | 451/398 |

(List continued on next page.)

FOREIGN PATENT DOCUMENTS

| | | |
|---|---|---|
| 0146004A3 | 6/1985 | European Pat. Off. . |
| 0517594A1 | 12/1992 | European Pat. Off. . |
| 0517595A1 | 12/1992 | European Pat. Off. . |
| 793997 | 7/1935 | France . |
| 3411120A1 | 3/1983 | Germany . |
| 3802561A1 | 8/1989 | Germany . |
| 59-232768 | 12/1984 | Japan . |
| 62-162466 | 7/1987 | Japan . |
| 63-200965 | 8/1988 | Japan . |
| 63-251166 | 10/1988 | Japan . |
| 63-267155 | 11/1988 | Japan . |
| 2269552 | 11/1990 | Japan . |
| 2269553 | 11/1990 | Japan . |
| 4-250967 | 9/1992 | Japan . |
| 7111256 | 4/1995 | Japan . |
| 2007784 | 2/1994 | Russian Federation . |
| WO94/17957 | 8/1994 | WIPO . |

OTHER PUBLICATIONS

"A New Pad and Equipment Development for ILD Planarization" by Toshiyasu Beppu, Motoyuki Obara and Yausuo Minamikawa, Semiconductor World, Jan., 1994, MY Mar. 17, 1994.

"Application of Chemical Mechanical Polishing to the Fabrication of VLSI Circuit Interconnections", William J. Patrick, William L. Guthrie, Charles L. Stadley and Paul M. Schiable, J. Electrochem. Soc., vol. 138, No. 6, Jun. 1991, pp. 1778–1784.

"Theory & Practice of Lubrication for Engineers", Dudley Fuller, Wiley–Interscience, 1st ed., pp. 22–25 and 86.

Practical Ideas, Jun. 1994, p. 67.

*Primary Examiner*—Bruce M. Kisliuk
*Assistant Examiner*—Andrew Weinberg
*Attorney, Agent, or Firm*—Brinks Hofer Gilson & Lione

[57] ABSTRACT

A semi-conductor wafer polishing machine having a polishing pad assembly and a wafer holder includes a support positioned adjacent the polishing pad assembly. This support has at least one fluid inlet connectable to a source of fluid at a higher pressure, at least one fluid outlet connectable to a fluid drain at a lower pressure, and at least one bearing surface over which fluid flows from the source to the drain. The polishing pad is supported by the fluid over the bearing surface for low-friction movement with respect to the support. Similar fluid bearings can be used in the wafer holder. An array of generally parallel grooves is provided on a belt support surface to reduce hydroplaning of a polishing belt. A turbine drive system rotates a wafer chuck in a wafer holder.

25 Claims, 11 Drawing Sheets

U.S. PATENT DOCUMENTS 5,205,082 4/1993 Shendon et al. ..... 51/283 R
5,212,910 5/1993 Breivogel ..... 51/398
5,230,184 7/1993 Bukhmah ..... 451/505
5,232,875 8/1993 Tuttle et al. .
5,246,525 9/1993 Sato .
5,274,964 1/1994 Simpson et al. .
5,276,999 1/1994 Bando .
5,287,663 2/1994 Pierce et al. ..... 51/401
5,297,361 3/1994 Baldy et al. ..... 51/119
5,329,732 7/1994 Karlsrud et al. ..... 51/131.5
5,329,734 7/1994 Yu ..... 51/283 R
5,335,453 8/1994 Baldy et al. ..... 51/67
5,399,125 3/1995 Dozier .
5,456,627 10/1995 Jackson et al. .

10
12
14
16
18
20
22
24
26
28
30
32
42
W
X

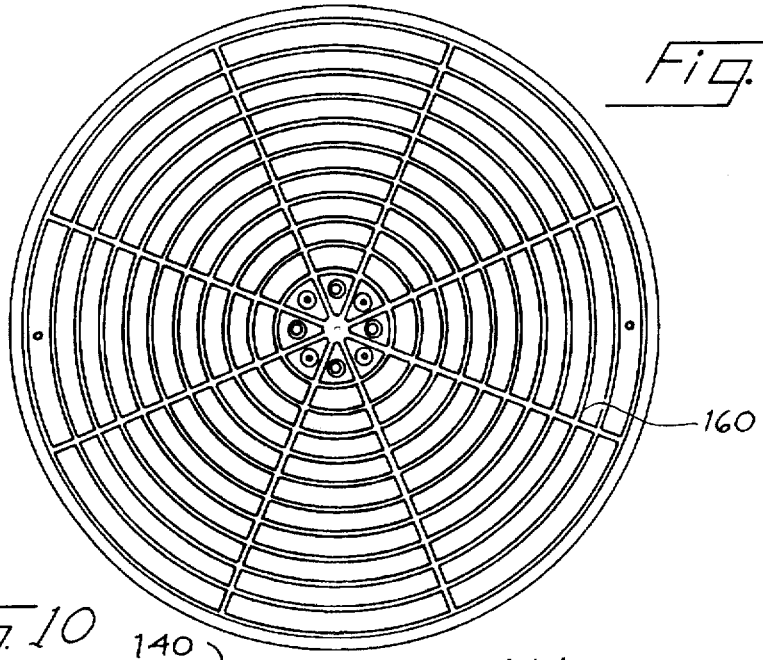
Fig. 11
Fig. 10
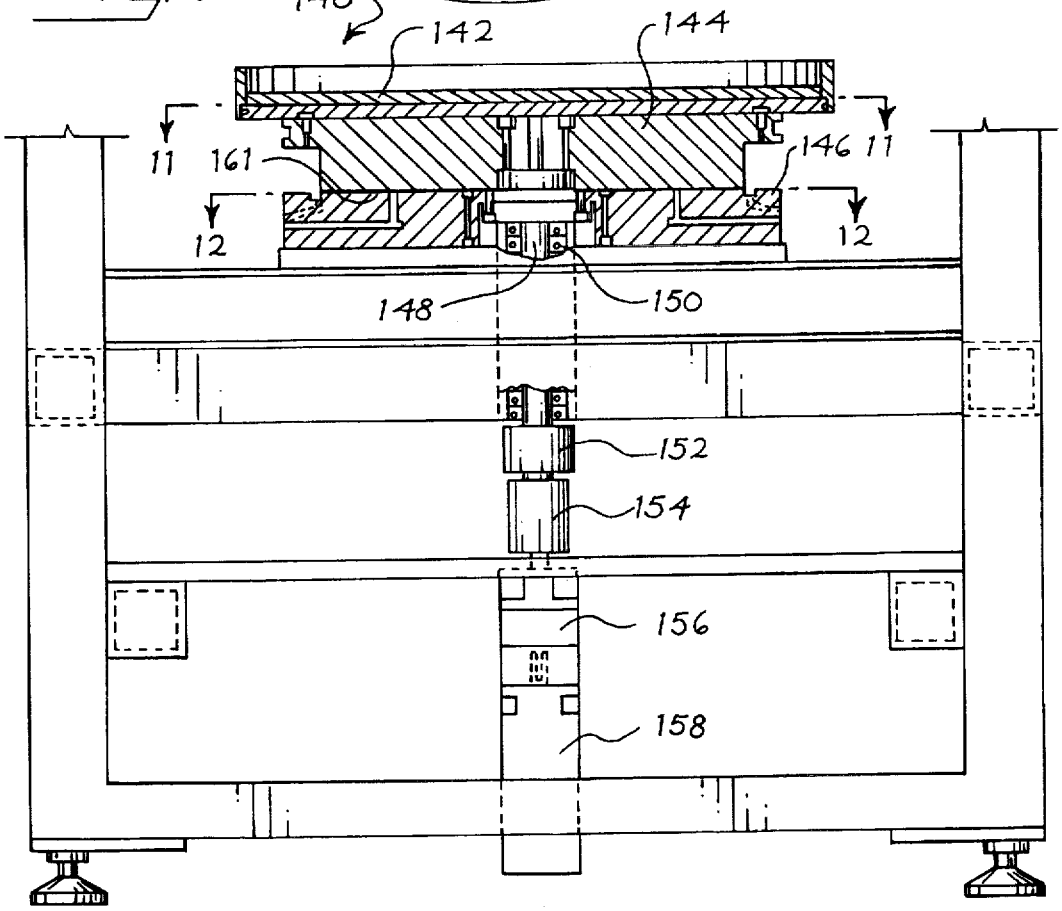

WAFER POLISHING MACHINE WITH FLUID BEARINGS AND DRIVE SYSTEMS

This invention relates to chemical mechanical polishing machines for planarizing semi-conductor wafers, and in particular to such machines having improved bearings.

Chemical mechanical polishing machines for semi-conductor wafers are well known in the art, as described for example in U.S. Pat. Nos. 5,335,453, 5,329,732, 5,287,663, 5,297,361 and 4,811,522. Typically, such polishing machines utilize mechanical bearings for the polishing pad and the wafer holder. Such mechanical bearings can provide disadvantages in operation. Mechanical bearings can become contaminated with the abrasive slurry used in the polishing process. If mechanical bearings provide point or line support for a polishing pad platen, the possibility of cantilever bending of the platen arises. Bearing vibrations can result in undesirable noise, and bearing adjustment typically requires a mechanical adjustment of the assembly. This adjustment is typically a high-precision, time-consuming adjustment.

It is an object of the present invention to provide a chemical mechanical polishing machine having fluid bearings that to a large extent overcome the problems set out above.

SUMMARY OF THE INVENTION

This invention relates to semi-conductor wafer polishing machines of the type comprising at least one polishing pad assembly and at least one wafer holder positioned to hold a semi-conductor wafer against the polishing pad assembly.

According to a first aspect of this invention, such a polishing machine is provided with a support positioned adjacent the polishing pad assembly. At least one of the support and polishing pad assembly includes at least one fluid inlet connectable to a source of fluid at a higher pressure, at least one fluid outlet connectable to a fluid drain at a lower pressure, and at least one bearing surface over which fluid flows from the source to the drain. The polishing pad assembly is supported by the fluid over the bearing surface for low-friction movement with respect to the support.

According to a second aspect of this invention, a semi-conductor wafer polishing machine having a polishing pad assembly and a wafer holder as described above includes a fluid bearing in the wafer holder. The wafer holder comprises a support which defines a hemispherical recess and a wafer chuck which comprises a hemispherical surface received within the hemispherical recess to form a ball joint. At least one of the hemispherical surface and the hemispherical recess comprises at least one fluid inlet connectable to a source of fluid at a higher pressure, at least one fluid outlet connectable to a fluid drain at a lower pressure, and at least one bearing surface over which fluid flows from the source to the drain. The hemispherical surface is supported by the fluid over the bearing surface for low-friction rotation with respect to the support about a center of rotation.

According to a third aspect of this invention, a semi-conductor wafer polishing machine of the type having a belt support, a belt mounted for movement across the support, at least one polishing pad mounted on the belt, and at least one wafer holder positioned to hold a semi-conductor wafer against the polishing pad includes a liquid film between the belt and the belt support. Generally parallel grooves in the belt support are aligned with a direction of motion of the belt. These grooves are configured to reduce hydroplaning of the belt.

According to a fourth aspect of this invention, a turbine drive system is provided to apply torque to a wafer chuck in a wafer holder.

The following detailed description provides a number of examples of the manner in which the chemical mechanical polishing machine of this invention can incorporate fluid bearings to support the polishing pad and the wafer, with machines that move the polishing pads in linear and rotational motions.

BRIEF DESCRIPTION OF THE DRAWINGS

FIG. 10 is a vertical cross sectional view of portions of a chemical mechanical polishing machine which incorporates another embodiment of this invention.

FIG. 11 is a top view taken along line 11—11 of FIG. 10.

DETAILED DESCRIPTION OF THE PRESENTLY PREFERRED EMBODIMENTS

Figures 1, 2:
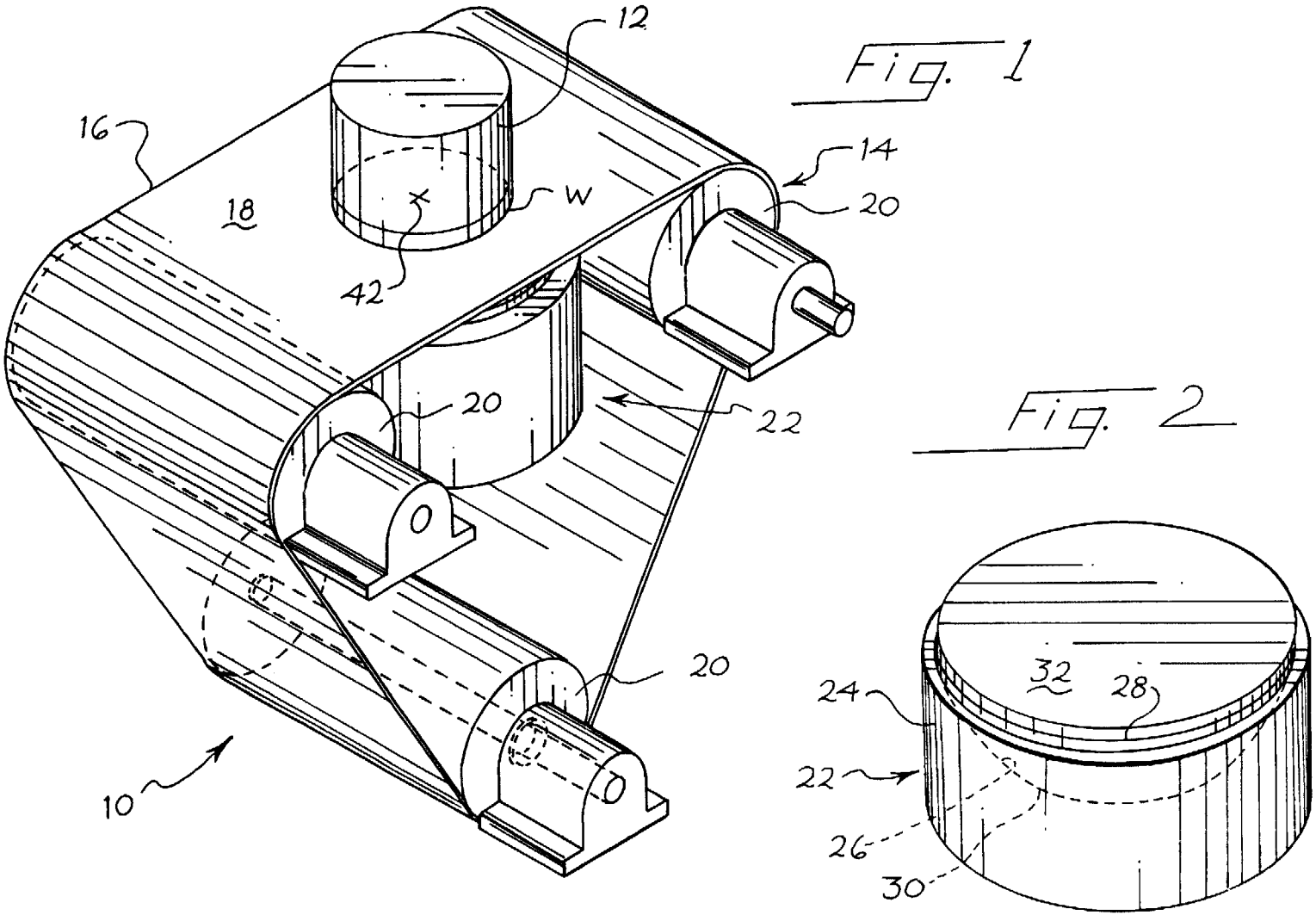
FIG. 1 is a perspective view of a first embodiment of a chemical mechanical polishing machine incorporating the present invention.
FIG. 2 is a perspective view of a belt support assembly included in the embodiment of FIG. 1.
Figure 3:
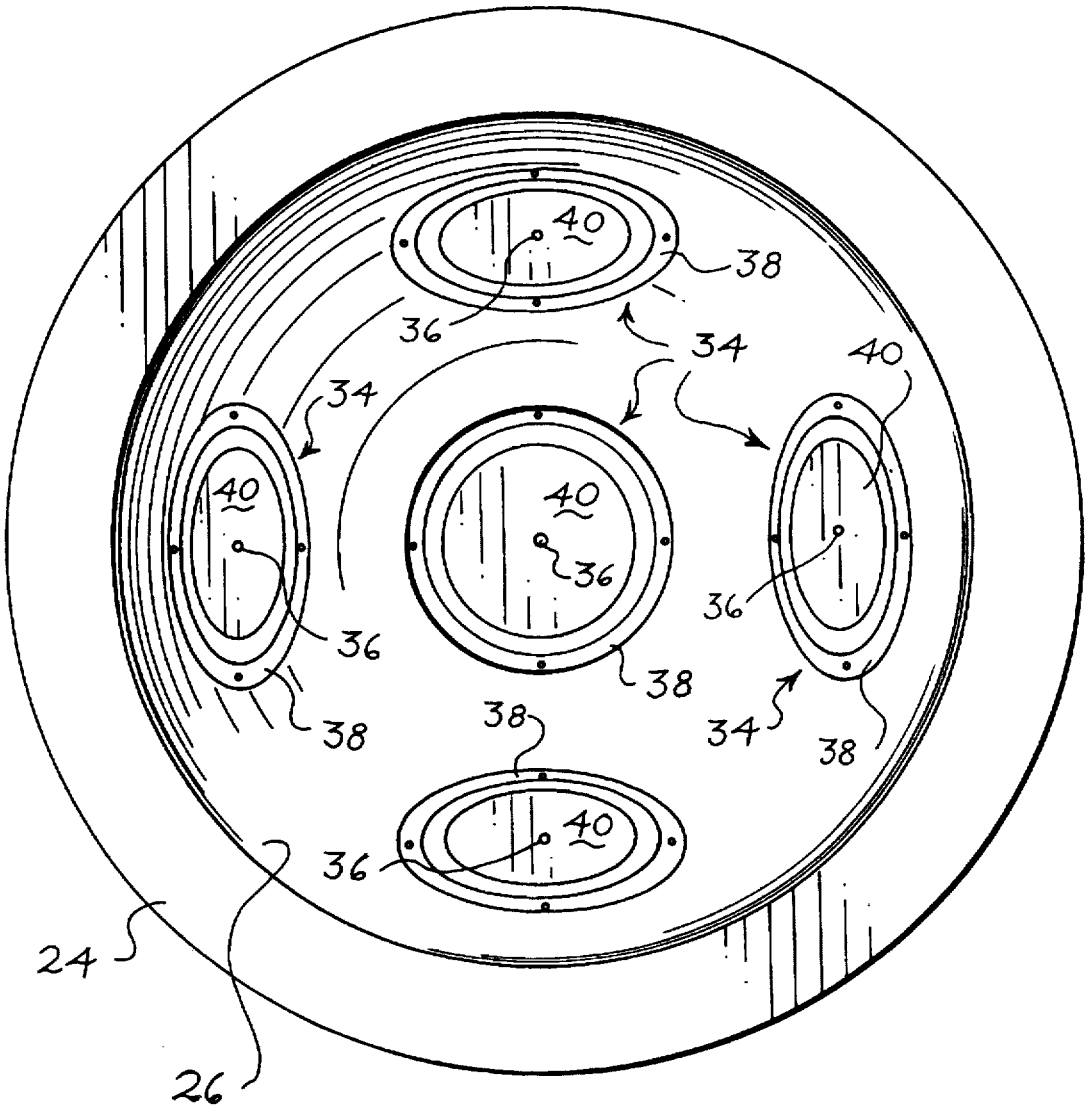
FIG. 3 is a top view of hydrostatic bearings included in the belt support assembly of FIG. 2.
Figure 4:
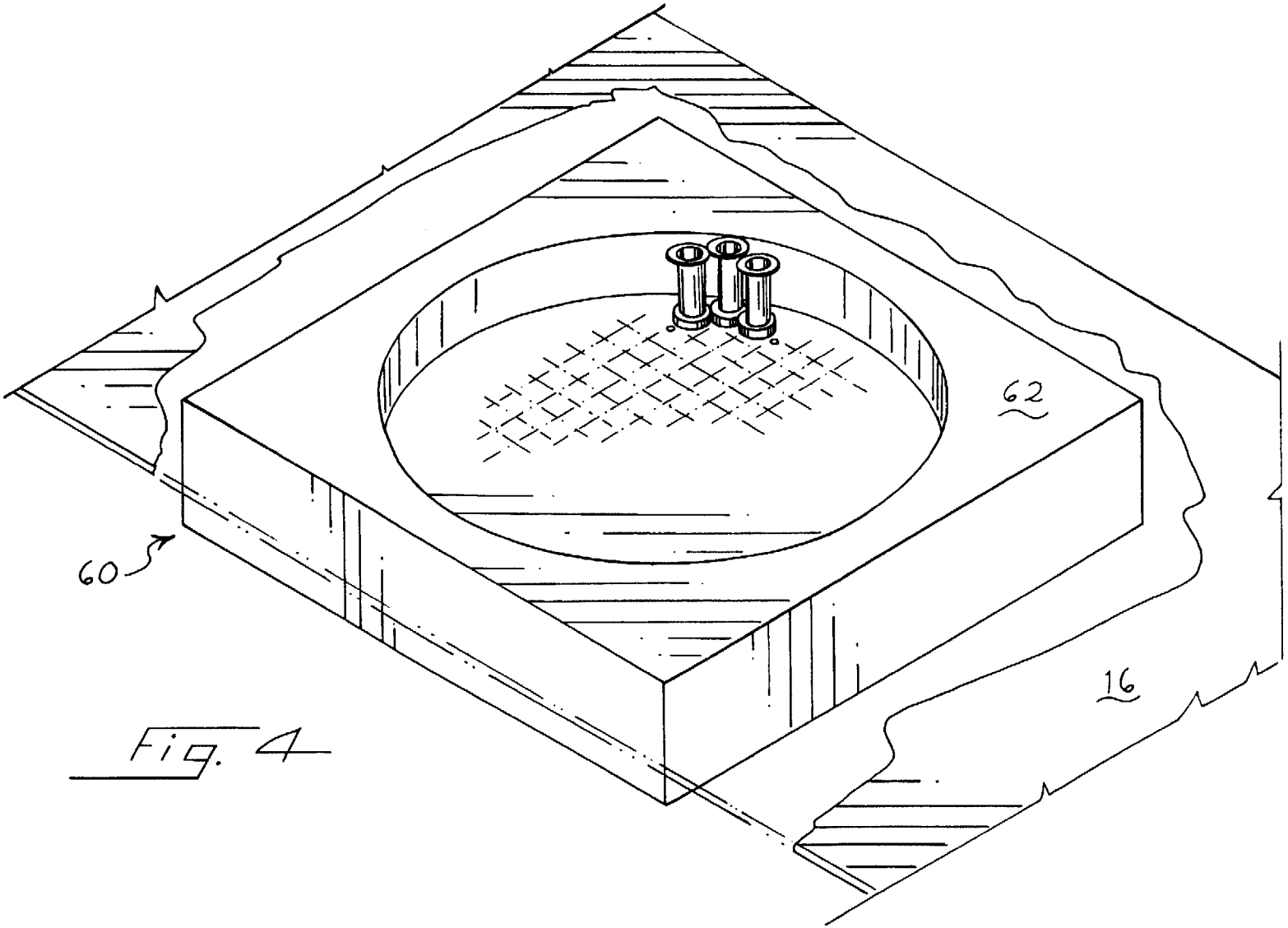
FIG. 4 is a perspective view of portions of a chemical mechanical polishing machine which incorporates a second preferred embodiment of this invention.

Turning now to the drawings, FIGS. 1–3 relate to a chemical mechanical wafer polishing machine 10 that incorporates a first preferred embodiment of this invention. This wafer polishing machine 10 includes a wafer holder 12 which holds a wafer W against a polishing pad assembly 14. The polishing pad assembly 14 includes a belt 16 which carries on its outer surface one or more polishing pads 18. The belt 16 travels over rollers 20 which are driven in rotation to cause the belt to move linearly past the wafer holder 12. The belt 16 is supported with respect to movement away from the wafer W by a belt support assembly 22 which is shown more clearly in FIG. 2. The belt support assembly 22 includes a support 24 which is fixedly mounted in position with respect to the rollers 20. This support 24 defines a hemispherical recess 26 which supports a belt platen 28. The belt platen 28 defines a lower hemispherical surface 30 that is received within the recess 26 to form a ball joint. The uppermost portion of the platen 28 defines a belt support surface 32. The belt 16 may be wetted and the belt support surface 32 may be grooved as described below in connection with FIGS. 8–9 to prevent the belt 16 from hydro-planing. Alternatively, the belt support surface 32 may be formed of a low-friction bearing material.

Further details regarding the wafer polishing machine 10 can be found in U.S. patent application Ser. No. 08/287,658 filed Aug. 9, 1994, assigned to the assignee of this invention. This application is hereby incorporated by reference in its entirety.

According to this invention, the platen 28 and the support 24 form at least one fluid bearing which allows low-friction movement of the platen 28 with respect to the support 24. FIG. 3 is a top view into the recess 26 with the platen 28 removed. As shown in FIG. 3, the recess 26 defines a total of five fluid bearings 34 in this embodiment. One of these fluid bearings 34 is larger than the other four and is positioned centrally. The remaining four fluid bearings 34 are positioned symmetrically around the central fluid bearing. Each of the fluid bearings includes a central fluid inlet 36 which is connectable to a source of fluid under pressure and a respective fluid outlet 38 that is annular in shape and extends around the fluid inlet 36. Each fluid outlet 38 is connectable to a drain of fluid at a lower pressure than that of the source. The region of the recess 26 between the fluid inlet 36 and the fluid outlet 38 forms a bearing surface 40. In use, fluid is pumped from the fluid inlet 36 across the bearing surface 40 to the fluid outlet 38. In this way a film of fluid is formed over the bearing surface 40, and it is this film of fluid that supports the hemispherical surface 30 of the platen 28.

The larger central fluid bearing 34 supports the platen 28 against movement away from the belt 16. The four smaller fluid bearings 34 provide self-centering characteristics in order maintain the platen 28 centered in the recess 26.

Returning to FIGS. 1 and 2, the recess 26 and the hemispherical surface 30 are shaped such that the center of rotation 42 of the ball joint formed by the support 24 and the platen 28 is positioned substantially at the front surface of the wafer W that is being polished. In this way, tilting moments on the platen 28 are minimized and any tendency of the ball joint formed by the platen 28 and the support 24 to press the belt 16 with greater force into the leading edge of the wafer W is minimized or eliminated.

Figure 5:
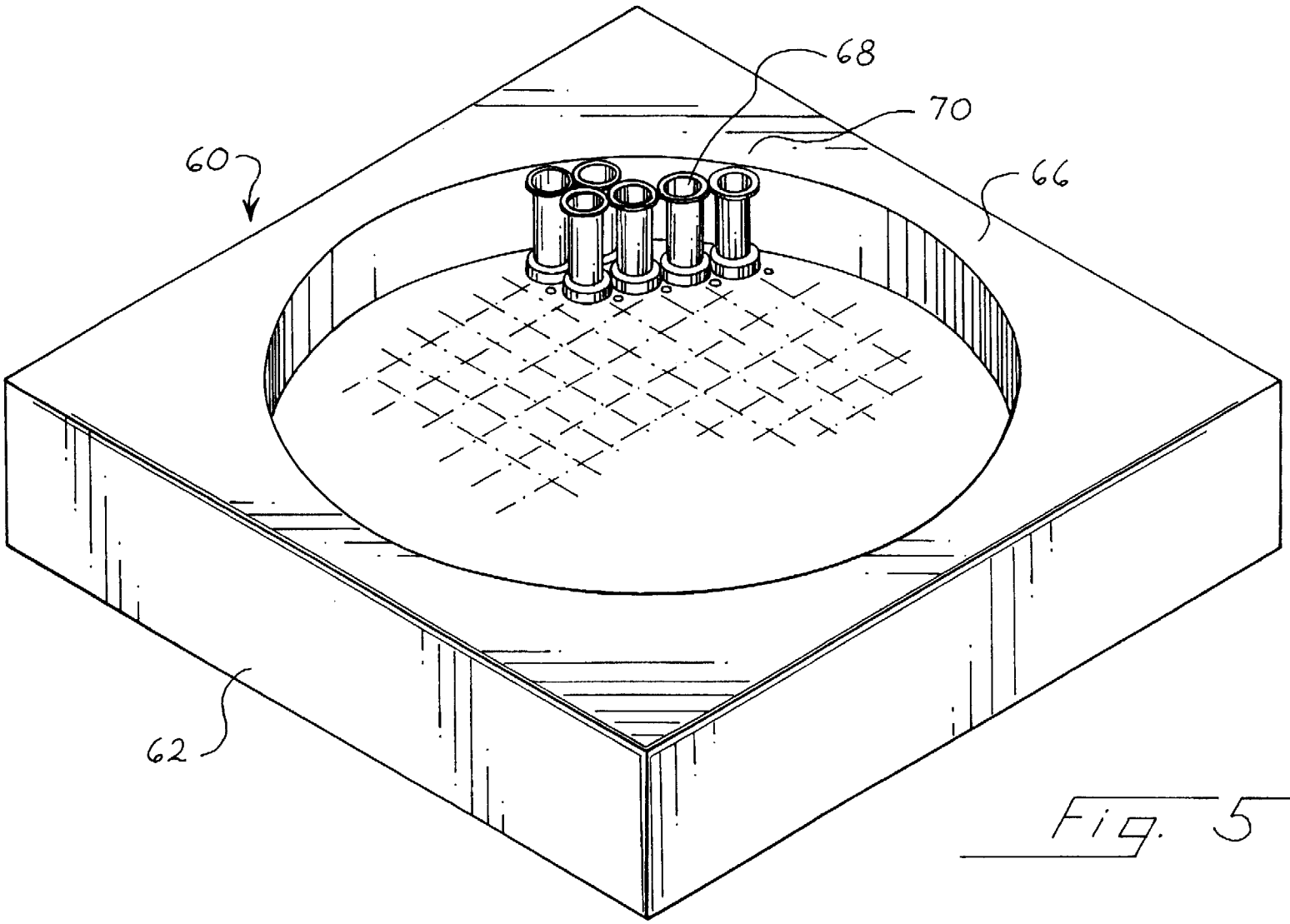
FIG. 5 is a perspective view of the belt support assembly of the embodiment of FIG. 4.
Figure 6:
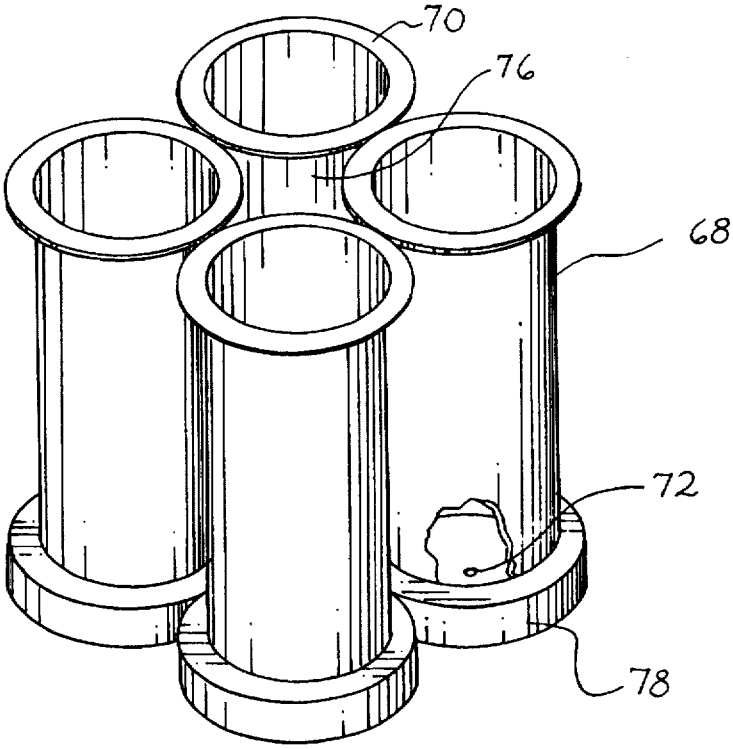
FIG. 6 is a perspective view at an expanded scale of a portion of the belt support assembly of FIG. 5.
Figure 7:
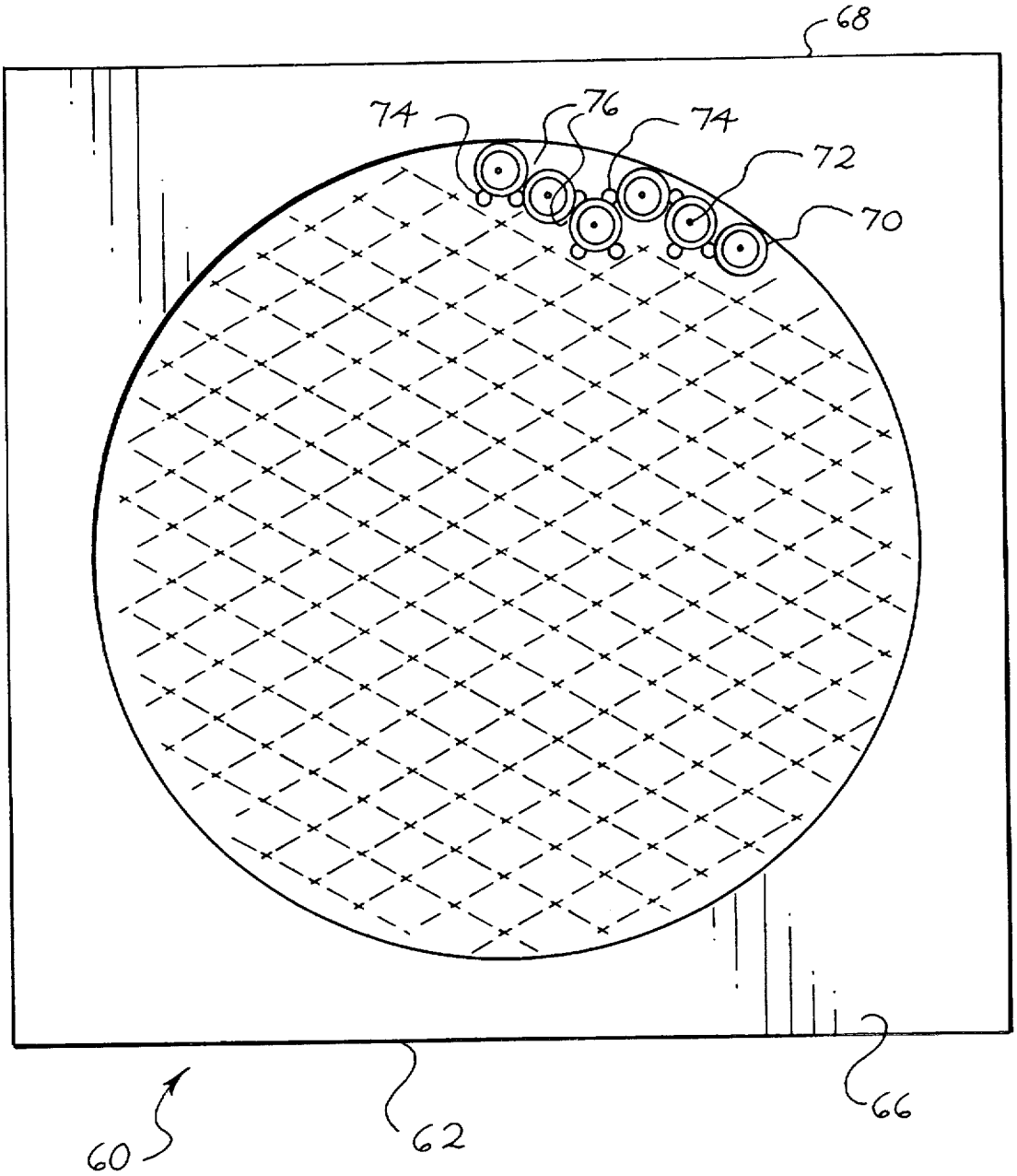
FIG. 7 is a top view of the belt support assembly of FIG. 5.

FIGS. 4–7 relate to a second preferred embodiment of this invention in which the belt 16 is supported by a belt support assembly 60. This belt support assembly 60 includes a support 62 which acts as a manifold for pressurized fluid and includes a raised peripheral rim 66 (FIG. 5). A plurality of cylindrical tubes 68 are contained within the rim 66, and each of these tubes 68 defines an exposed annular end surface 70. The manifold is connected to the interiors of the tubes 68 via fluid inlets 72, and a plurality of fluid outlets 74 are provided as shown in FIG. 7. Individual ones of the tubes 68 are sealed to the support 62 by seals 78 that allow a controlled amount of movement of the tubes 68. For example, the seal 78 can be formed of an elastomeric O-ring which bears against a lower cap of the tube 68, and the fluid inlet 72 can be a hollow fastener that secures the tube 68 to the support 62 and compresses the seal 78. As best shown in FIGS. 6 and 7, interstitial spaces 76 between adjacent tubes 68 allow fluid to flow out of the tubes 68 to the fluid outlets 74.

Simply by way of example, the tubes 68 can define an array having a diameter of about eight inches, and 187 tubes can be used, each having an outside diameter of ½ inch and an inside diameter of ⅜ inch, and the fluid inlets 72 can be about 0.030 inches in diameter.

In use, the manifold is connected to a source of fluid such as water at an elevated pressure, and the fluid outlets 74 are connected to a fluid drain at a lower pressure such as atmospheric pressure. Fluid flows into the tubes 68 via the fluid inlet 72, across the end surfaces 70 which act as bearing surfaces, via the interstitial spaces 76 and the fluid outlets 74 to the fluid drain. The fluid flow over the end surfaces 70 provides broad-area support for the belt 16.

Figure 9:
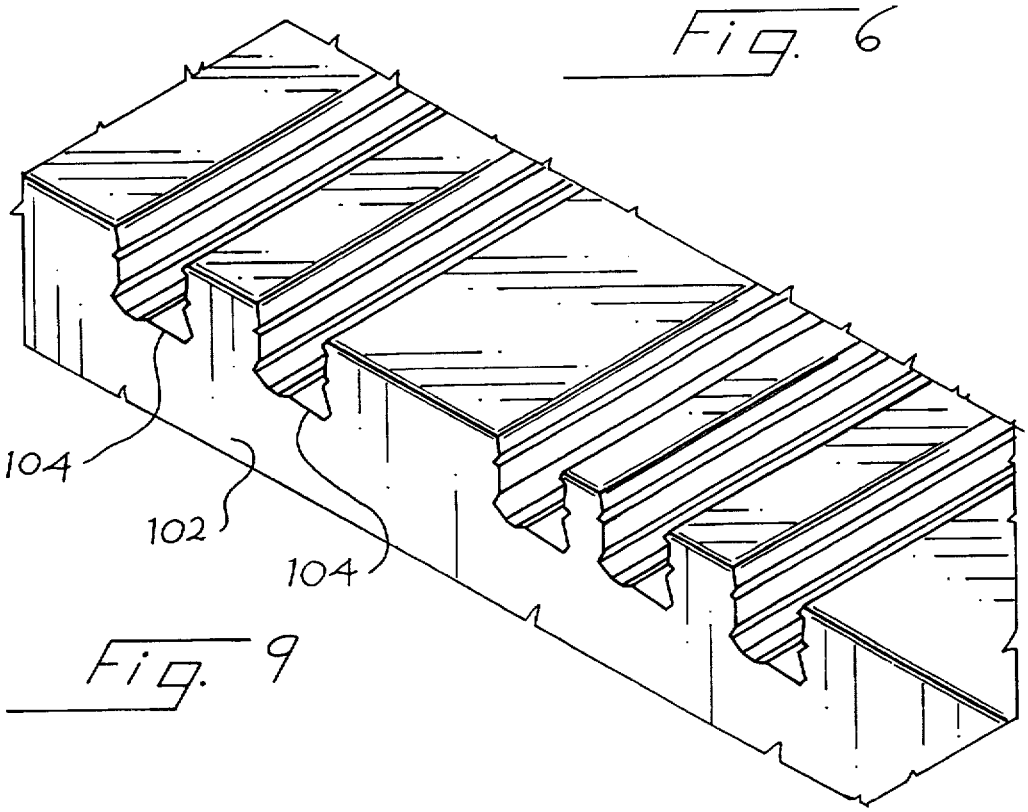
FIG. 9 is an enlarged perspective view of a portion of the belt support assembly of FIG. 8.
Figure 8:
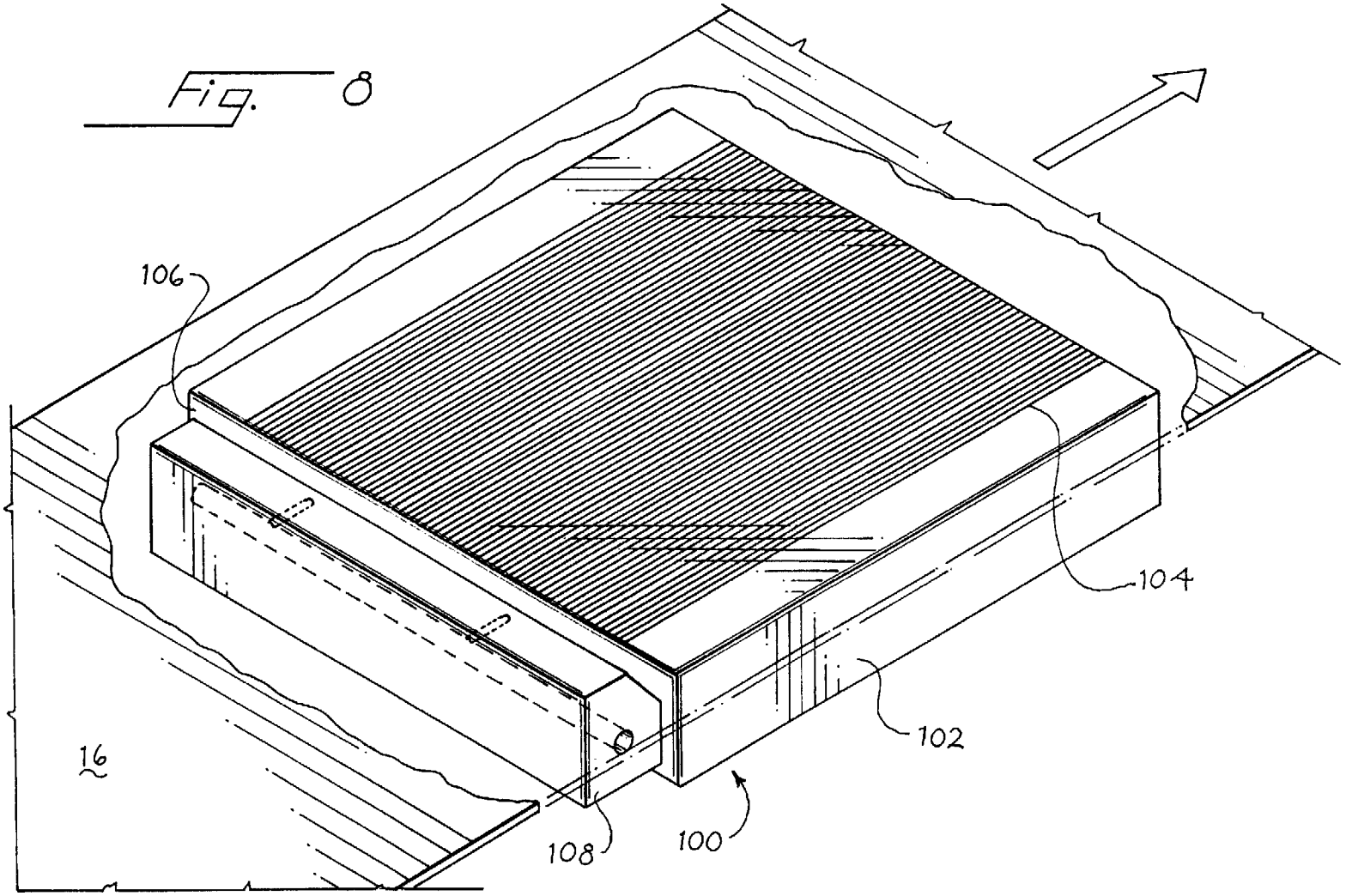
FIG. 8 is a perspective view of portions of a third chemical mechanical polishing machine incorporating this invention.

FIGS. 8 and 9 relate to a third preferred belt support assembly 100 which can be used in the wafer polishing machine 10 described above. The belt support assembly 100 includes a platen 102 which defines an array of parallel grooves 104 extending along the direction of travel of the belt 16. Preferably, the grooves are shallow in depth and narrow in width, such as for example approximately 0.001 inches or less in each dimension.

Simply by way of example, the platen 102 can be made from a bearing-grade material such as Delrin AF®, Vesbel®, or Torlon®. Such bearing-grade materials provide low friction, which reduces heat and wear. A manifold 108 injects a slurry-compatible liquid such as water between the belt 16 and the platen 102 to form a liquid film 106 on the underside of the belt 16. Hydroplaning of the belt 16 over the platen 102 is reduced or eliminated by the grooves 104.

Suitable grooves 104 can be formed by scoring the top surface of a flat, bearing-grade material in one direction only with 20 grit sandpaper. Then the burrs and the raised edges are sanded down with 400 grit sandpaper and the upper surface of the platen 102 is lapped flat. The end result is that the belt support surface of the platen 102 has small linear grooves that break up hydrodynamic fluid films. Once hydrodynamic fluid films are broken up, the fluid now flows between the belt 16 and the platen 102 by means of boundary or lubrication flow. This flow lowers friction and also carries away localized heat build up resulting from the friction. If desired, the surface asperities of the platen 102 can be allowed to touch the belt 16 slightly, allowing some degree of hydrodynamic fluid film.

In alternate embodiments the platen 102 can be formed as a rigid plate of a material such as stainless steel coated with a layer of low-friction material such as Teflon®. If the layer is thin enough, the plate can be provided with grooves before the layer is applied, and the layer will conform to the grooves. Alternately, grooves can be formed in the layer after it is applied to the plate.

FIGS. 10–13 relate to a fourth preferred embodiment of this invention which utilizes a wafer polishing machine having a rotary polishing pad assembly 140. This assembly 140 includes a polishing pad 142 that is supported on a polishing table or platen 144. The polishing table 144 is in turn supported on a table support 146 against motion perpendicular to the polishing pad 142. The polishing table 144 is guided in rotary motion by a shaft 148 that is supported in bearings 150. A vacuum coupling 152 allows connection to a vacuum source that applies vacuum to vacuum hold down grooves 160 in order to hold the polishing pad 142 in place. The shaft 148 is coupled via a shaft coupling 154 and a gear box 156 to a direct drive motor 158. This motor 158 rotates the table 144 and the polishing pad 142 during polishing operations.

Figure 12:
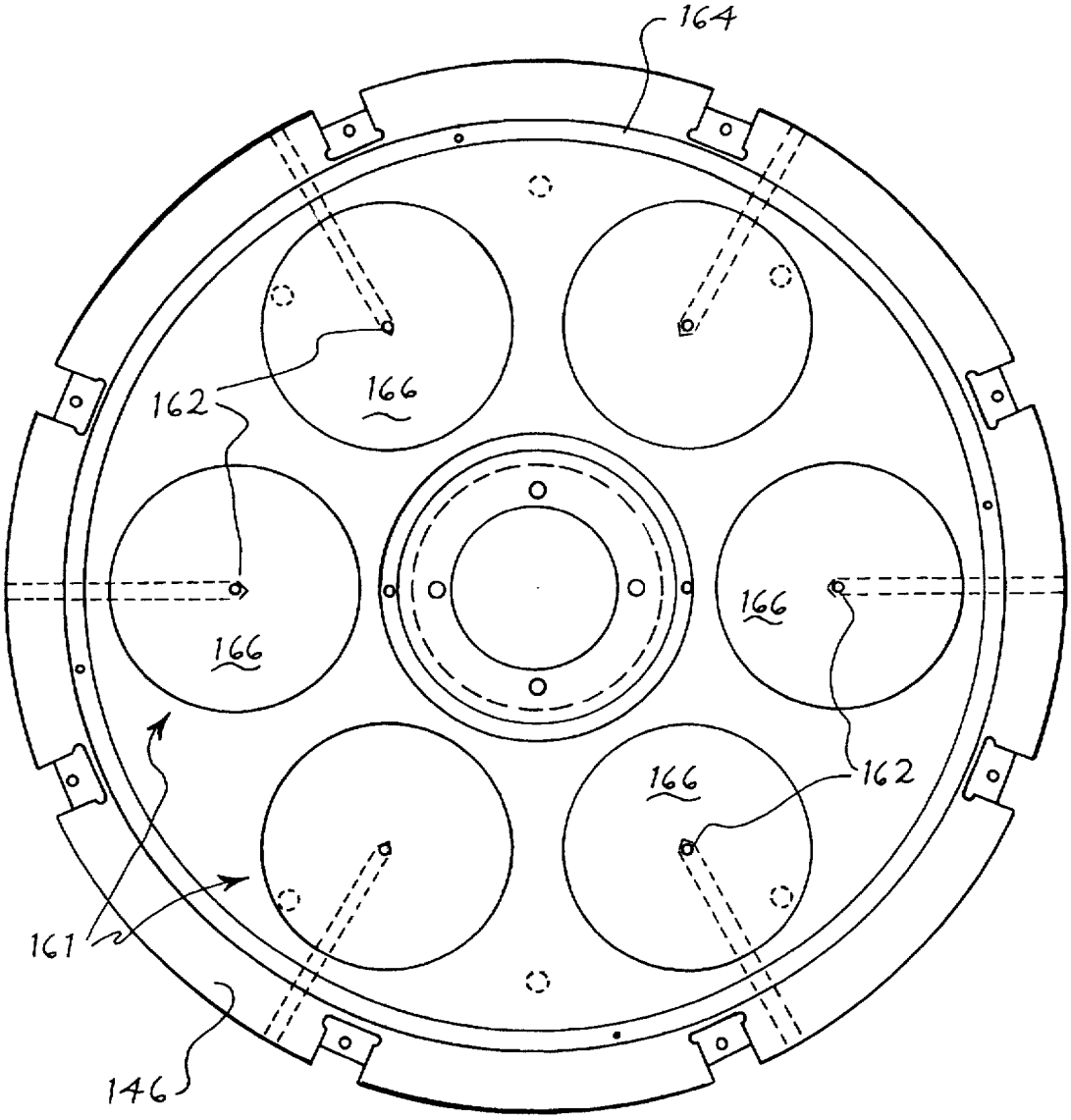
FIG. 12 is a cross sectional view taken along line 12—12 of FIG. 10.

This embodiment provides a set of fluid bearings 161 on the upper surface of the table support 146 to provide broad-area, low-friction support for the polishing table 144. As best shown in FIG. 12, each of the fluid bearings 161 includes a central fluid inlet 162 connectable to a source of a suitable fluid such as water at an elevated pressure. A fluid outlet 164 is defined around the entire set of fluid bearings 161, and this fluid outlet 164 is connectable to a fluid drain at a lower pressure than that of the fluid source. A bearing surface 166 is formed by the table support 146, and fluid flows over the bearing surface 166 as it travels from the fluid inlets 162 to the fluid outlet 164. The polishing table 144 is supported by this fluid film over the bearing surfaces 166.

Figure 13:
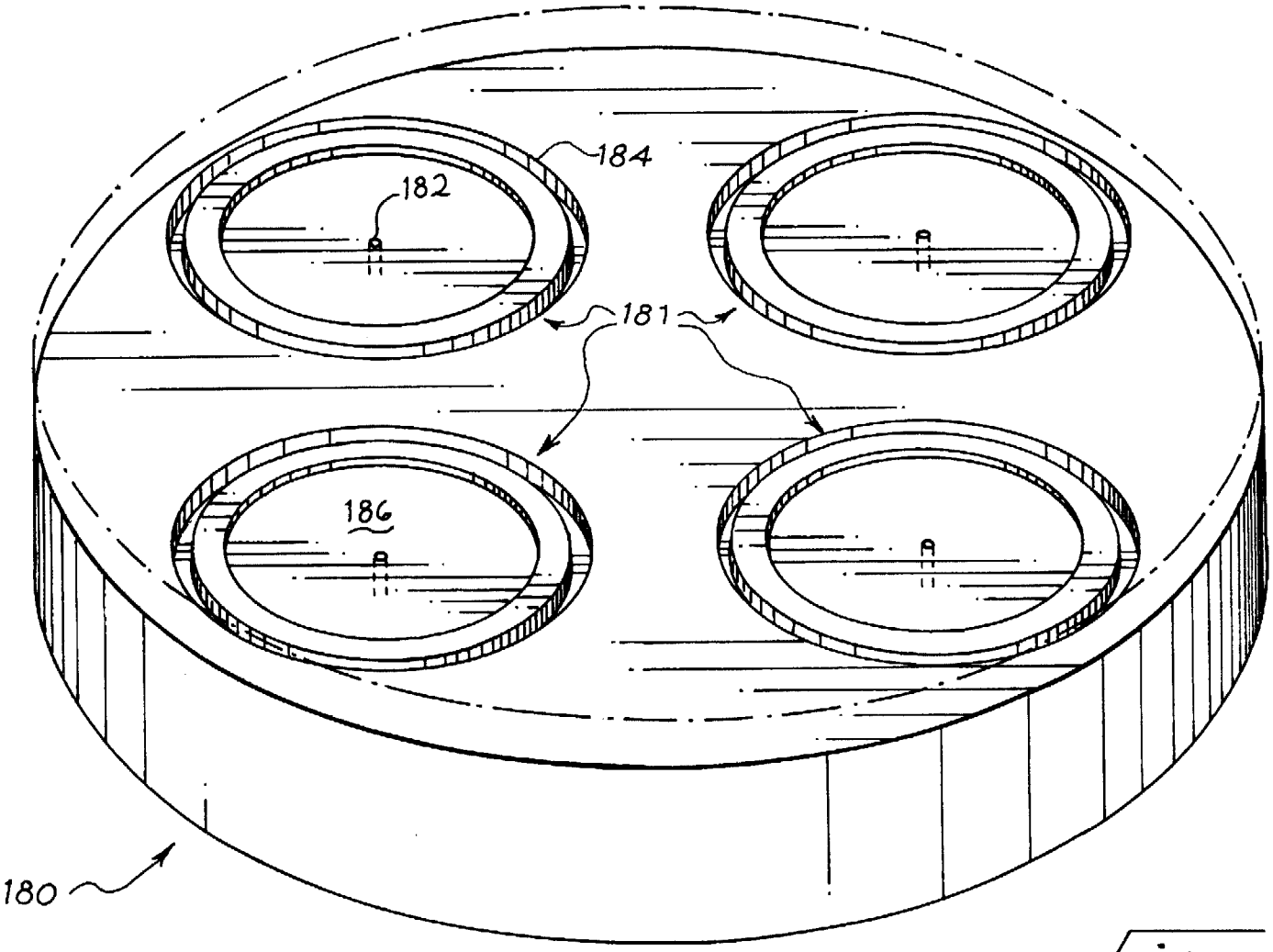
FIG. 13 is a perspective view of an alternative table support suitable for use in the embodiment of FIG. 10.

As shown in FIG. 13 an alternate design for the table support 180 includes four fluid bearings 181, each having a respective fluid inlet 182, fluid outlet 184 and bearing surface 186. In this embodiment each fluid outlet 184 surrounds only one respective fluid inlet 182.

Figure 14:
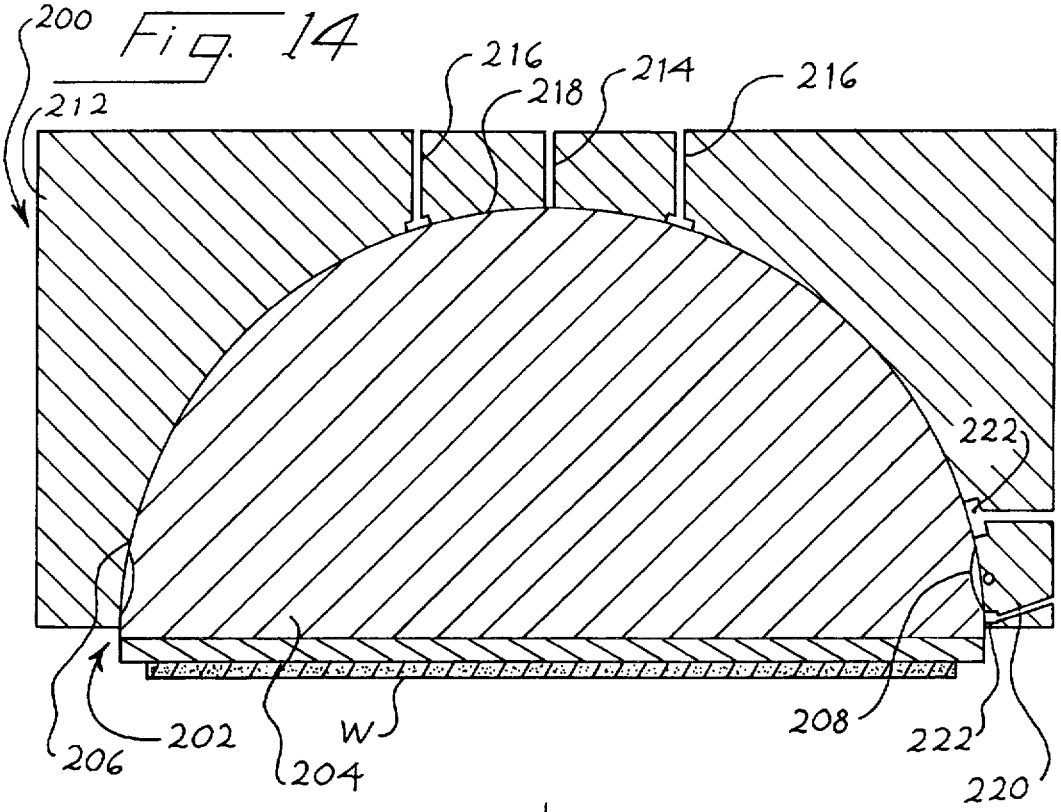
FIG. 14 is a cross-sectional view of a wafer holder that incorporates fluid bearings.
Figure 15:
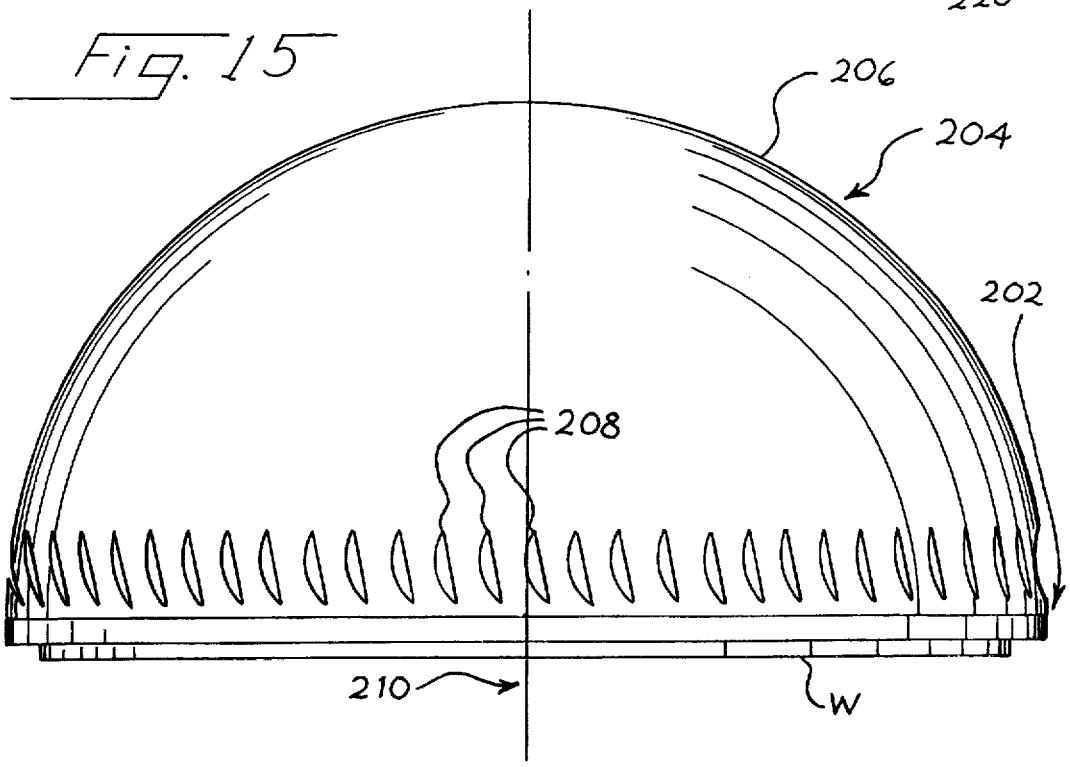
FIG. 15 is a side elevational view of a component of the wafer holder of FIG. 14.

As best shown in FIGS. 14 and 15, yet another embodiment of this invention provides a ball joint similar to that of FIGS. 1–3 in a wafer holder 200.

The wafer holder 200 includes a wafer chuck 202 which supports a wafer W on one side and includes a hemispherical element 204 on the other side. The element 204 defines a hemispherical bearing surface 206 and a circular array of fluid deflectors, which in this embodiment are crescent-shaped cutouts 208. FIG. 15 shows several of these cutouts 208, which can for example be formed with an edge of an endmill in a milling machine. For example 25–250 cutouts 208 can be arrayed symmetrically around the element 204 near the chuck 202. The hemispherical surface 206 is preferably centered about a center of rotation 210 that is centered on the front face of the wafer W.

As shown in FIG. 14, the element 204 is supported in a support 212 that defines a hemispherical recess to receive the element 204. Fluid bearings 214 are formed in the support, including fluid inlets 214, fluid outlets 216 and bearing surfaces 218. The fluid bearings 214 function identically to the fluid bearings discussed above in connection with FIG. 3, and can be arranged in a similar pattern.

The support 212 also includes an array of fluid inlets 220 that direct pressurized fluid against the cutouts 208 to rotate the element 204 in the support 212 during a polishing operation. Preferably, each fluid inlet 220 is oriented almost tangentially to the hemispherical surface 206. For example, there may be 5 to 50 fluid inlets 220, and they are sized to rotate the element 204 at a speed of ½ to 50 RPM. The fluid inlets 220 are surrounded on both sides by annular fluid outlets 222 that drain fluid after it has interacted with the cutouts 208.

If the holder 200 is intended for use with the support 212 above the element 204, means can be provided to prevent the element 204 from dropping out of the support 212. For example, a mechanical retainer or a vacuum holddown system (not shown) that do not interfere with articulation of the element 204 can be used.

The cutouts 208, fluid inlets 220 and fluid outlets 222 cooperate to form a turbine drive system. If desired, the support 212 can be rotated by any suitable drive system to rotate the wafer W, and the turbine drive system can be used to resist torque tending to rotate the element 204 with respect to the support 212, without contributing to the rotation of the wafer W.

The fluid bearings described above provide a number of important advantages. The constant flow of fluid out of the bearing allows for no slurry contamination. The hydrostatic bearings described above provide excellent stiffness and wide-area support, thereby reducing or eliminating cantilever bending of the platen. These bearings are nearly frictionless and vibrationless, and therefore they provide the further advantage of reduced noise. These bearings are extremely stable and robust, and they can readily be adjusted merely by controlling fluid pressure. This lends itself to simple, closed-loop feedback control systems. The preferred bearing fluid is liquid water, which is slurry compatible. These bearings are extremely reliable with hardly any maintenance or wear.

Of course, it should be understood that a wide range of changes and modifications can be made to the preferred embodiments described above. For example, other fluids including gasses can be used in place of water. If desired the fluid bearings can be formed on the platen rather than the support, and the fluid inlet and outlet may be formed on different components. The hemispherical surfaces described above may depart from a true hemisphere to some extent, for example to provide self-centering forces. It is therefore intended that the foregoing detailed description be regarded as illustrative rather than limiting, and that it be understood that it is the following claims, including all equivalents, that are intended to define the scope of this invention.

We claim:

1. In a semiconductor wafer polishing machine of the type comprising at least one polishing pad assembly and at least one wafer holder positioned to hold a semiconductor wafer against the polishing pad assembly, the improvement comprising:

a support positioned adjacent the polishing pad assembly, at least one of said support and said polishing pad assembly comprising a plurality of fluid inlets connectable to at least one source of a fluid at a higher pressure, a plurality of fluid outlets connectable to at least one fluid drain at a lower pressure, and a plurality of bearing surfaces over which fluid flows from the respective source to the respective drain, said polishing pad assembly supported by the fluid over the bearing surface for low-friction movement with respect to the support, both said fluid inlets and said fluid outlets interspersed among the bearing surfaces.

2. The invention of claim 1 wherein the polishing pad assembly comprises at least one polishing pad and a belt supporting the at least one polishing pad for linear translation.

3. In a semiconductor wafer polishing machine of the type comprising at least one polishing pad assembly and at least one wafer holder positioned to hold a semiconductor wafer against the polishing pad assembly, the improvement comprising:

a support positioned adjacent the polishing pad assembly, at least one of said support and said polishing pad assembly comprising at least one fluid inlet connectable to a source of a fluid at a higher pressure, at least one fluid outlet connectable to a fluid drain at a lower pressure, and at least one bearing surface over which fluid flows from the source to the drain, said polishing pad assembly supported by the fluid over the bearing surface for low-friction movement with respect to the support;

wherein the polishing pad assembly comprises a polishing pad, a rotatable platen supporting the polishing pad, and bearings coupled to the platen to guide the platen in rotational motion with respect to the support about a rotational axis.

4. The invention of claim 3 wherein the at least one bearing surface comprises at least four bearing surfaces symmetrically positioned around the rotational axis.

5. In a semiconductor wafer polishing machine of the type comprising at least one polishing pad assembly and at least one wafer holder positioned to hold a semiconductor wafer against the polishing pad assembly, the improvement comprising:

a support positioned adjacent the polishing pad assembly, at least one of said support and said polishing pad assembly comprising at least one fluid inlet connectable to a source of a fluid at a higher pressure, at least one fluid outlet connectable to a fluid drain at a lower pressure, and at least one bearing surface over which fluid flows from the source to the drain, said polishing pad assembly supported by the fluid over the bearing surface for low-friction movement with respect to the support;

wherein each bearing surface is annular, and wherein each fluid inlet is surrounded by the respective fluid bearing surface.

6. The invention of claim 5 wherein each fluid outlet is positioned around the respective bearing surface.

7. The invention of claim 5 wherein the at least one bearing surface comprises a plurality of bearing surfaces, and wherein the fluid outlet is positioned around the plurality of bearing surfaces.

8. In a semiconductor wafer polishing machine of the type comprising at least one polishing pad assembly and at least one wafer holder positioned to hold a semiconductor wafer against the polishing pad assembly, the improvement comprising:

a support positioned adjacent the polishing pad assembly, said support comprising at least one fluid inlet connectable to a source of a fluid at a high pressure, at least one fluid outlet connectable to a fluid drain at a lower pressure, and at least one bearing surface over which fluid flows from the source to the drain, said polishing pad assembly supported by the fluid over the bearing surface for low-friction movement with respect to the support;

wherein the support holds a plurality of tubes, each tube comprising an exposed annular end surface, wherein each fluid inlet is positioned within the respective tube, and wherein each bearing surface comprises the annular end surface of the respective tube.

9. The invention of claim 8 further comprising a plurality of seals, each seal interposed between the support and the respective tube, said seals accommodating relative motion of the tubes with respect to the support.

10. The invention of claim 8 wherein the tubes define interstitial passages between adjacent tubes, and wherein the at least one fluid outlet communicates with at least some of the interstitial passages.

11. In a semiconductor wafer polishing machine of the type comprising at least one polishing pad assembly and at least one wafer holder positioned to hold a semiconductor wafer against the polishing pad assembly, the improvement comprising:

a support positioned adjacent the polishing pad assembly, at least one of said support and said polishing pad assembly comprising at least one fluid inlet connectable to a source of a fluid at a higher pressure, at least one fluid outlet connectable to a fluid drain at a lower pressure, and at least one bearing surface over which fluid flows from the source to the drain, said polishing pad assembly supported by the fluid over the bearing surface for low-friction movement with respect to the support;

wherein said polishing pad assembly comprises at least one polishing pad and a platen supporting the polishing pad, said platen comprising a hemispherical surface;

wherein the at least one bearing surface comprises a plurality of bearing surfaces arranged around a hemispherical recess in the support, said recess receiving the hemispherical surface to form a ball joint.

12. The invention of claim 11 wherein the at least one polishing pad is supported on a belt, and wherein the belt is supported by the platen.

13. The invention of claim 12 wherein the platen comprises a belt support surface which comprises an array of generally parallel grooves aligned with a direction of motion of the belt, and wherein a liquid is interposed between the belt and the belt support surface to lubricate movement of the belt relative to the belt support surface.

14. The invention of claim 13 wherein the grooves are on average no more than about 0.001 inch in width.

15. The invention of claim 11 wherein the platen rotates about a center of rotation, and wherein the hemispherical surface is shaped such that the center of rotation is positioned at a surface of the wafer being polished.

16. The invention of claim 11 wherein each bearing surface is annular, and wherein each bearing surface surrounds the respective fluid inlet and is surrounded by the respective fluid outlet.

17. In a semiconductor wafer polishing machine of the type comprising at least one polishing pad assembly and at least one wafer holder positioned to hold a semiconductor wafer against the polishing pad assembly, the improvement comprising:

said wafer holder comprising a support comprising a hemispherical recess and a wafer chuck comprising a hemispherical surface received within the hemispherical recess to form a ball joint;

at least one of the hemispherical surface and the hemispherical recess comprising at least one fluid inlet connectable to a source of fluid at a higher pressure, at least one fluid outlet connectable to a fluid drain at a lower pressure, and at least one bearing surface over which fluid flows from the source to the drain, said hemispherical surface supported by the fluid over the bearing surface for low-friction rotation with respect to the support about a center of rotation.

18. The invention of claim 17 wherein the hemispherical surface is shaped such that the center of rotation is positioned at a surface of the wafer being polished.

19. The invention of claim 17 wherein each bearing surface is annular, and wherein each bearing surface surrounds the respective fluid inlet and is surrounded by the respective fluid outlet.

20. The invention of claim 17 wherein the water chuck comprises an array of fluid deflectors, and wherein the support comprises an array of second fluid inlets positioned to direct fluid at the fluid deflectors to apply torque to the wafer chuck.

21. The invention of claim 20 wherein the fluid deflectors are positioned adjacent to the wafer.

22. The invention of claim 21 wherein the second fluid inlets are each oriented almost tangentially to the hemispherical surface.

23. In a semiconductor wafer polishing machine of the type comprising at least one polishing pad assembly and at least one wafer holder positioned to hold a semiconductor wafer against the polishing pad assembly, the improvement comprising:

said wafer holder comprising a support comprising a hemispherical recess and a wafer chuck comprising a hemispherical surface received within the hemispherical recess to form a ball joint;

said wafer chuck comprising an array of fluid deflectors;

said support comprising an array of fluid inlets positioned to direct fluid at the fluid deflectors to apply torque to the wafer chuck.

24. The invention of claim 23 wherein the fluid deflectors are positioned adjacent to the wafer.

25. The invention of claim 24 wherein the fluid inlets are each oriented almost tangentially to the hemispherical surface.

* * * * *